US005669051A

United States Patent [19]

Ochiai et al.

[11] Patent Number: 5,669,051

[45] Date of Patent: Sep. 16, 1997

[54] METHOD OF ELECTROSTATICALLY FORMING VISUAL IMAGE

[75] Inventors: Masahisa Ochiai, Fukaya; Tsutomu Saitoh; Masumi Asanae, both of Kumagaya, all of Japan

[73] Assignee: Hitachi Metals, Ltd., Tokyo, Japan

[21] Appl. No.: 627,182

[22] Filed: Apr. 3, 1996

[30] Foreign Application Priority Data

Apr. 4, 1995 [JP] Japan ..... 7-078778

[51] Int. Cl.[6] ..... G03G 13/09

[52] U.S. Cl. ..... 399/277; 430/108

[58] Field of Search ..... 355/251, 245, 355/246; 430/110, 106.6, 108

[56] References Cited

U.S. PATENT DOCUMENTS

| | | | |
|---|---|---|---|
| 5,246,513 | 9/1993 | Kawamura et al. | 430/106.6 |
| 5,432,033 | 7/1995 | Asanae et al. | 399/276 X |
| 5,483,329 | 1/1996 | Asanae et al. | 355/251 X |
| 5,554,477 | 9/1996 | Ozawa et al. | 430/106.6 |

FOREIGN PATENT DOCUMENTS

| | | |
|---|---|---|
| 57-130407 | 8/1982 | Japan . |
| 59-905 | 1/1984 | Japan . |
| 59-226367 | 12/1984 | Japan . |
| 62-201463 | 9/1987 | Japan . |
| 7-64342 | 3/1995 | Japan . |

*Primary Examiner*—Arthur T. Grimley
*Assistant Examiner*—Quana Grainger
*Attorney, Agent, or Firm*—Morgan, Lewis and Bockius, LLP

[57] ABSTRACT

A method in which a photoconductive surface is charged to a uniform potential by a charging brush and a two-component magnetic developer is directly attracted on the surfaced of a sleeve-less developing roll formed from a permanent magnet member and transported by the rotation of the permanent magnet member. An electrostatic latent image is developed with the transported magnetic developer in a developing zone to form a visual toner image on the photoconductive drum. The toner image is transferred to a recording sheet by a transfer roll and permanently fixed thereon by a suitable fixing means. The specific volume resistance of the magnetic carrier is restricted to a particular range to prevent the magnetic carrier from adhering to the photoconductive surface.

8 Claims, 1 Drawing Sheet

METHOD OF ELECTROSTATICALLY FORMING VISUAL IMAGE

BACKGROUND OF THE INVENTION

The present invention relates to a method of electrophotographically producing a visual toner image wherein an electrostatic latent image on a rotating photoconductive drum (image-bearing member) is developed by a magnetic developer attractively retained on the surface of a developer transporting means formed from a cylindrical permanent magnet member. In particular, an electrophotographic visual image-forming method by which the adhesion of a carrier in the magnetic developer to the surface of the photoconductive drum can be effectively avoided.

In a known electrophotographic imaging process and electrostatic recording process utilized in printers, facsimile machines, etc., an electrostatic latent image is formed on the surface of a cylindrical photoconductive drum. A developing roll composed of a sleeve and a permanent magnet mounted interiorly of the sleeve and rotatably relative to the sleeve is disposed opposite to the photoconductive drum. A magnetic developer is magnetically attracted on the surface of the sleeve and transported by the relative rotation of the sleeve and the magnet. The magnetic developer transported to a developing zone forms a magnetic brush which brushes the surface of the photoconductive drum to develop the electrostatic latent image to a visual toner image. The toner image is transferred onto a recording sheet which is then heated to permanently fix the toner image thereon.

In the conventional image forming apparatus, a corona discharging method, in which a high voltage such as DC 5–8 kV is applied to a metal wire to generate corona, is employed to charge the photoconductive surface to a uniform potential and transfer the toner image onto the recording sheet. However, the corona discharge is accompanied with undesired by-products such as ozone, nitrogen oxides (NOx), etc. to cause air pollution due to discomfortable odor, etc. The undesired by-products change the properties of the photoconductive surface to reproduce obscure or blurred images. Further, when the corona wire is stained, the toner images with non-developed portion, undesired toner lines on the background, etc. are produced.

In the corona transfer, a recording sheet is applied with a corona charge of the opposite polarity to that of the toner particles in the toner image. The charge applied to the recording sheet overcomes the attraction of the latent image to the toner particles and electrostatically pulls them onto the recording sheet. Therefore, the transferring process is considerably affected by an ambient moisture which changes the electrical resistance of the recording sheet. Also, when the resistance of the recording sheet is low, the transfer efficiency of the toner images to the recording sheet is undesirably reduced.

The corona discharge utilizes only 5–30% of a supplied electric current for charging the photoconductive surface and a recording sheet, and the greater part of the supplied current is lost through a shield plate. Thus, a charging means and a transferring means utilizing corona discharge are low in the power efficiency. Therefore, a large quantity of power and a high-voltage transformer with high capacity are required for obtaining a desired effect.

To eliminate the above problems in corona discharge, an image forming method employing a brush charging means and a roll transferring means have been proposed.

Further, a requirement to develop small-sized imaging machines has been recently increased. To meet the increasing requirement, it is important to minimize the developing parts. As a proposal realizing the minimization, a developing roll with no sleeve has been proposed to attractively retain magnetic developer on the permanent magnet surface directly and transport the retained magnetic developer to the developing zone by the rotation of the permanent magnet only (JP-A-62-201463).

FIG. 1 is a schematic view showing a sleeve-less image forming apparatus employing a brush charging means. In FIG. 1, a magnetic developer 2 mainly comprising a toner and a magnetic carrier is stored in a developer storage 1. A cylindrical permanent magnet member 4 is rotatably disposed in the lower portion of the developer storage 1. The permanent magnet member 4 has on its exterior circumferential surface a plurality of magnetic poles extending along the axial direction, and at least the surface thereof is made electrically conductive.

The permanent magnet member 4 is formed from a resin-bonded magnet comprising a ferromagnetic powder and a resin as disclosed in JP-A-57-130407, JP-A-59-905, JP-A-59-226367, etc. The surface of the permanent magnet member 4 is made electrically conductive by coating or plating a conductive layer on the surface, or by adding an electrically conductive material during kneading the starting material. A semi-conductive permanent magnet member made of a hard ferrite magnet may be also used.

A photoconductive drum 3 which is rotatable in the direction indicated by an arrow is disposed opposite to the permanent magnet member 4 with a developing gap (g). The thickness of the magnetic developer layer magnetically attracted on the surface of the permanent magnet member 4 is regulated by a doctor blade 5 which is attached to an end portion of the developer storage 1 with a doctor gap (t). A brush charging means 6, a transfer roll 7, a cleaning means 8 and a blade 9 are disposed around the photoconductive drum 3. The magnetic developer 2 attracted on the permanent magnet member 4 is biased with direct current from an electric source (not shown) through the permanent magnet member 4 or the doctor blade 5.

Upon rotating each of the photoconductive drum 3, permanent magnet member 4 and transfer roll 7 in the direction indicated by an arrow, the surface of the photoconductive drum 3 is brushed with the charging brush of the brush charging means 6 to be charged to a uniform potential. The charged portion of the photoconductive drum 3 is exposed to a light image (not shown) to record an electrostatic latent image corresponding to the original information to be reproduced. Separately, the magnetic developer 2 is attracted on the permanent magnet member 4 and transported to a developing zone defined by the space between the photoconductive drum 3 and the permanent magnet member 4. In the developing zone, a toner in the magnetic developer 2 is deposited on the electrostatic latent image by the electrostatic attraction of the latent image to form a visual toner image on the photoconductive drum 3.

The visual toner image is transferred to a recording sheet 10 by the transfer roll 7. The transferred toner image moves in the direction indicated by an arrow and is fixed to the recording sheet 10 by a fixing means (not shown). The toner remaining on the photoconductive drum 3 after transferring step is recovered into the cleaning means 8 by the blade 9 contacting with the surface of the photoconductive drum 3.

However, In the above conventional image forming method, the magnetic carrier in the magnetic developer 2 is likely to adhere to the photoconductive drum 3. The adhered carrier passed through the blade 9 causes various drawbacks when reaches the charging brush 6. For example, since the magnetic carrier is usually electrically conductive, a leak of charge occurs when the magnetic carrier on the photoconductive drum 3 is brought into contact with the charging brush 6. This causes non-uniform charging of the photoconductive surface, generation of loud noise, image defects such as black spots, etc. and, in the extreme case, involves a danger of fires.

A solution for the above problems may be to tightly and strongly press the blade 9 on to the surface of the photoconductive drum 3 to completely remove the adhered carrier. However, this is likely to damage the photoconductive surface and decreases the life of the photoconductive drum 3. Such problems caused by the adhered carrier on the photoconductive drum 3 becomes more serious in a small-sized image forming apparatus omitting a cleaning means 8.

OBJECT AND SUMMARY OF THE INVENTION

Accordingly, an object of the present invention is to provide a method of electrophotographically forming visual images which is free from the problems mentioned above, in particular, capable of avoiding the carrier adhesion to the photoconductive surface thereby producing visual images of high quality.

As a result of the intense research in view of the above objects, the inventors have found that a combination of a charging brush, a sleeve-less developing roll (cylindrical permanent magnet member) and a magnetic carrier having a specific volume resistance of particular range can effectively prevent the magnetic carrier from adhering to the photoconductive surface.

Thus, in an aspect of the present invention, there is provided a method of electrostatically forming visual image, comprising the steps of (1) charging the surface of a rotating photoconductive drum to a uniform potential by a charging brush; (2) exposing the charged surface of the photoconductive drum to a light image to form an electrostatic latent image; (3) forming a visual toner image on the photoconductive drum by developing the electrostatic latent image in a developing zone with a two-component magnetic developer which is transported to the developing zone by a rotating cylindrical permanent magnet member having on the circumferential surface thereof a plurality of magnetic poles extending along the axial direction, the magnetic developer comprising a magnetic carrier having a specific volume resistance of $10^5$–$10^{10}$ Ω·cm; (4) transferring the toner image to a recording sheet by means of a transfer roll; and (5) fixing the transferred toner image to the recording sheet.

DETAILED DESCRIPTION OF THE INVENTION

Figure 1:
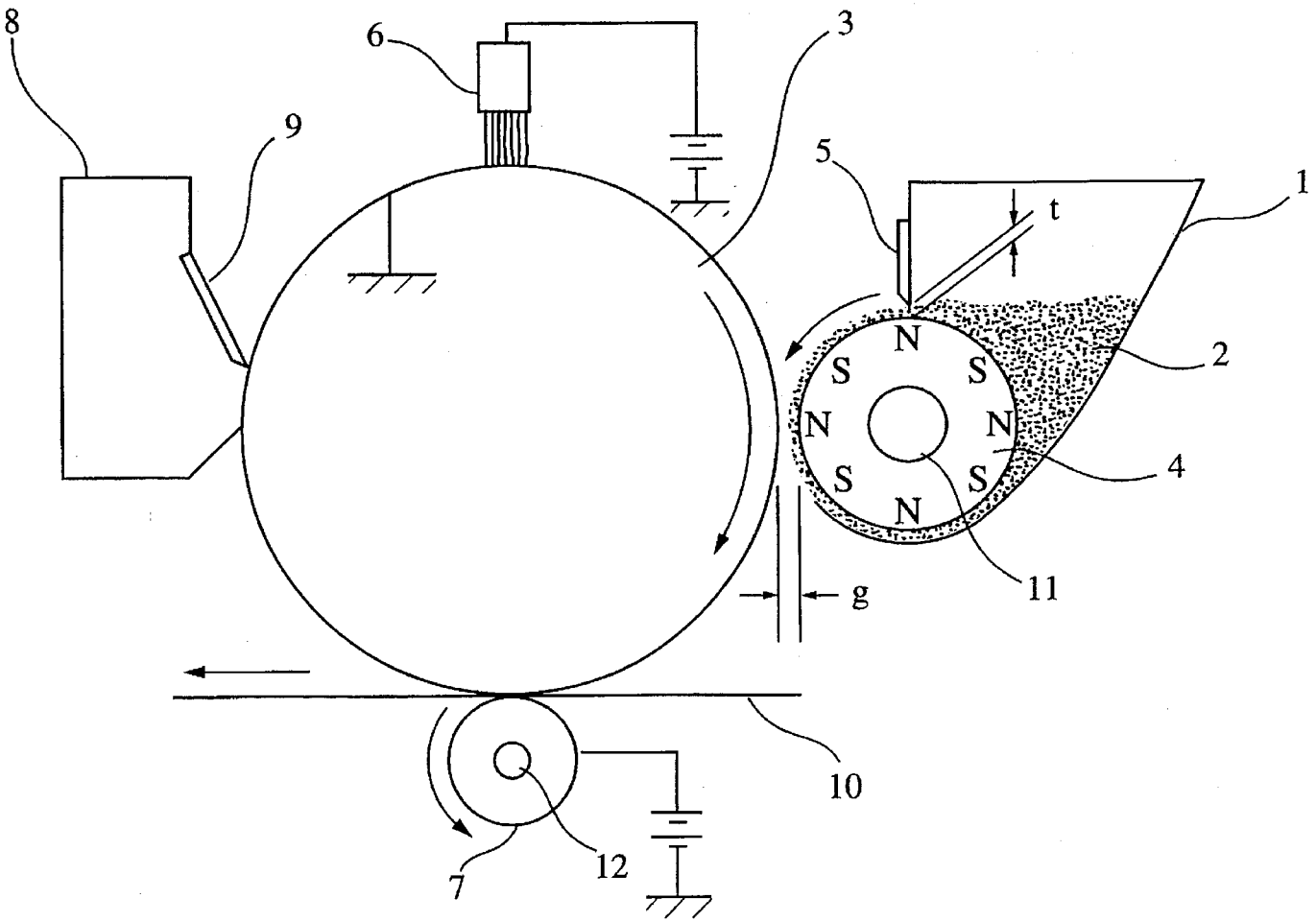
FIG. 1 is a schematic view showing a sleeve-less image forming apparatus employing a charging means with a charging brush.

In the image forming method of the present invention, an image forming apparatus as shown in FIG. 1 may be used.

Initially, a photoconductive drum 3 having a photoconductive surface which may be formed from an organic photoconductive material, etc. rotates to a charging zone where the photoconductive surface is charged by a charging brush 6 to a uniform potential, preferably in the range of 400–800 V by means of absolute value. The bristle of the charging brush 6 is necessary to be electrically conductive and preferred to have a specific volume resistance of $10^6$ ω·cm or less. The electrically conductive material for the bristle may include carbon fiber, fibers containing therein dispersed electrically conductive particles such as carbon black particles metal powder, etc.

Next, the charged photoconductive surface rotates to an exposure zone and exposed there by a known exposure unit to a light image corresponding to the original information to be reproduced. Subsequent to the recording of the electrostatic latent image on the photoconductive surface, the photoconductive drum 3 rotates to bring the electrostatic latent image to a developing zone.

Separately, a magnetic developer 2 described in detail below is magnetically attracted on the surface of a permanent magnet member 4 and transported to the developing zone through a doctor blade 5. In the developing zone, the electrostatic latent image is developed by a contact- or jumping-developing method to form a visual toner image on the photoconductive surface.

The permanent magnet member 4 may be composed of a ferrite magnet or a resin bonded magnet mainly composed of a magnetic powder and a resin material which may include one or more of ethylene-ethyl acrylate copolymers, polyamides, chlorinated polyethylenes, etc. The permanent magnet member 4 may be a roll integrally molded on the outer surface of a shaft 11, or the permanent magnet member 4 and the shaft 11 may be integrally molded from the material described above. The permanent magnet member 4 is preferred to have no seam on the exterior circumferential surface thereof to avoid uneven development.

The surface magnetic flux density decreases with the number of the magnetic pole on the exterior circumferential surface of the permanent magnet member 4, because the N-poles and S-poles are alternatively aligned in the circumferential direction with a small inter-pole pitch. A surface magnetic flux density of 50 G or more is preferred to prevent the magnetic developer from scattering, and 1200 G or less is preferred to readily deposit the toner to the latent image on the photoconductive drum 3. The preferred range for the surface magnetic flux density is 100–800 G. The number of magnetic poles is preferably 8–60 because such a number of magnetic poles generates a surface magnetic flux density of 50–1200 G.

Since the magnetic field around the surface of the permanent magnet member 4 decreases smaller with the increase in the number of magnetic poles, the amount of the magnetic developer 2 attracted on the permanent magnet member 4 also becomes smaller. Therefore, the magnetic developer layer on the permanent magnet member 4 becomes wavy or undulated to cause uneven development. To eliminate this problem, the permanent magnet member 4 is rotated faster in the case of an increased number of magnetic poles. However, when rotated too fast, the driving torque is unfavorably large and the carrier in the magnetic developer 2 is abraded. On the other hand, when rotated too slowly, images of uneven density are produced. In view of the above, the peripheral speed (Vm) of the permanent magnet member 4 is preferably 1 to 10 times, more preferably 2 to 6 times the peripheral speed (Vp) of the photoconductive drum 3. The peripheral speed (Vm) is preferably 50–250 mm/sec, more preferably 100–200 mm/sec.

Further, the peripheral speeds (Vm and Vp), the outer diameter of the permanent magnet member 4 and the number of magnetic poles (M) are preferred to be selected so that the value for h (mm) expressed by the following formula:

$h=\pi D \cdot Vp/M \cdot Vm$ is less than 2 (mm). The value h means the circumferential length of the photoconductive surface to move during the surface of the permanent magnet member 4 moves inter-pole pitch, namely, the photoconductive surface faces most closely to each magnetic pole every time the photoconductive surface moves a length of h. Since uneven development becomes appreciable when 2 mm or more, the value of h is preferably less than 2 mm, more preferably 1 mm or less. The value of h can be made minute by increasing the peripheral speed (Vm) and the number of magnetic poles (M). However, the surface magnetic flux density is reduced when M is too large to result in scattering of the magnetic developer 2, and the problems mentioned above are raised when Vm is too large. Therefore, the value for h is preferably 0.4–1.0 mm in practical developing operations A doctor blade 5 is attached to an end portion of a developer storage 1 with or without a gap between the tip thereof and the surface of the permanent magnet member 4 to regulate the thickness of the magnetic developer layer attracted on the permanent magnet member 4. The doctor gap (t) is preferably 0.1–0.4 mm and the developing gap (g) is selected so as to satisfy the formula: g–t=0–0.2 mm. When a flexible and elastic doctor blade made of magnetic material such as SK steel, etc. or non-magnetic material such as SUS304, phosphor bronze, etc. is used, the doctor blade may be disposed with no gap so as to contact with or be pressed on the surface of the permanent magnet member 4.

The magnetic developer 2 on the permanent magnet member 4 is preferred to be biased with direct current, for example, through the permanent magnet member 4. For this purpose, the surface of the permanent magnet member 4 is coated with an electrically conductive layer of, for example, a non-magnetic metal such as Cu, SUS, aluminum alloys, etc. When the permanent magnet member 4 is semi-conductive or electrically insulating, the doctor blade 5 is preferably made from an electrically conductive material such as metals, etc. to bias the magnetic developer 2 on the permanent magnet member 4 therethrough. A relatively low frequency alternating current of 20 kHz or less, preferably 10 kHz or less may be superimposed to direct current. The peak-to-peak value (Vp-p) is preferably 100–2000 V, more preferably 200–1200 V.

After development, the visual toner image is moved to a transfer zone where the toner image is transferred to a recording sheet 10 by a transfer roll 7. The transfer roll 7 may comprise a metal shaft 12 around which an electrically conductive elastic layer of urethane rubber, butadiene rubber, ethylene-propylene rubber, etc. is coated. The elastic layer is preferred to have a specific volume resistance of $10^6$ Ω·cm or less. Then, the sheet is moved to a fixing zone where the transferred image is permanently fixed on the sheet by a known fixing means.

The toner remaining on the photoconductive drum after transferring the toner image to the recording sheet may be recovered by a cleaning means 8 having a blade 9 contacting the surface of the photoconductive drum 3. However, since the carrier adhesion to the photoconductive drum 3 is effectively avoided in the method of the present invention, the cleaning means 8 may be omitted to minimize the apparatus.

In the method of the present invention, two-component magnetic developer comprising a magnetic toner and a magnetic carrier (10–90 weight % toner concentration) or comprising a non-magnetic toner and a magnetic carrier (5–60 weight % toner concentration) may be used.

As the carrier, a magnetic particle such as iron powder, ferrite powder, magnetite powder, resin bonded particle comprising a resin containing a dispersed magnetic powder, etc. may be used. With respect to the shape of the carrier, a flat carrier is preferable rather than a spherical carrier because the toner obtains a sufficient amount of triboelectric charge. The carrier is preferred to have an average particle size of 10–150 μm, preferably 10–50 μm, a specific volume resistance of $10^5$–$10^{10}$ Ω·cm, preferably $10^6$–$10^9$ Ω·cm, and a magnetization ($\sigma_{1000}$) of 30 emu/g or more, preferably 60 emu/g or more at 1000 Oe magnetic field. An average particle size exceeding 150 μm is not desirable because the carrier fails to give the toner a sufficient triboelectric charge. When the average particle size is less than 10 μm, the magnetization (σ1000) is lower than 30 emu/g, or the specific volume resistance is lower than $10^5$ Ω·cm, the carrier is likely to adhere to the photoconductive drum 3, which results in deterioration of image quality, occurrence of leak at the charging brush 6, difficulty in providing the toner with a constant amount of triboelectric charge, etc. When the specific volume resistance exceeds $10^{10}$ Ω·cm, the magnetic developer 2 on the permanent magnet member is hard to be biased to result in deterioration of image quality.

The specific volume resistance is regulated within the range of $10^5$–$10^{10}$ Ω·cm, for example, by coating the surface of the carrier with a resin. The resin coating thus formed on the carrier may optionally contain therein and/or on the surface thereof an additive such as electrically conductive particles such as carbon black powder, metal powder, etc., charge controlling agent, anti-oxidant, etc. For example, the electrically conductive particles may be internally added in the resin layer in an amount about 5–15 weight % based on the total amount of the resin layer, while about 0.5–5 weight parts based on 100 weight parts of the carrier core when externally added to the resin layer.

Suitable materials for the resin layers may include homopolymers or copolymers of styrene compound such as p-chlorostyrene, methylstyrene, etc.; vinyl halides such as vinyl chloride, vinyl bromide, vinyl fluoride, etc.; vinyl esters such as vinyl acetate, vinyl propionate, vinyl benzoate, etc.; esters of α,β-unsaturated aliphatic monocarboxylic acid such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, butyl methacrylate, etc.; nitriles such as acrylonitrile, methacrylonitrile, etc.; amides such as acrylamide, etc.; vinyl ethers such as vinyl methyl ether, vinyl isobutyl ether, vinyl ethyl ether, etc.; vinyl ketones such as vinyl ethyl ketone, vinyl hexyl ketone, methyl isopropenyl ketone, etc. Other resins such as epoxy resins, silicone resins, rosin-modified phenol-formaldehyde resins, cellulose resins, polyether resins, polyvinyl butyral resins, polyester resins, styrene-butadiene resins, polyurethane resins, polycarbonate resins, fluorocarbon resins such as tetrafluoroethylene, etc. may be also usable. These resin materials may be used alone or in combination. Among them, styrene-acrylic resins, silicone resins, epoxy resins, styrene-butadiene resins, cellulose resins, etc. are particularly preferable.

The carrier is coated with resins, for example, according to the following method. First, the resin material is dissolved in an adequate solvent such as benzene, toluene, xylene, methyl ethyl ketone, tetrahydrofuran, chloroform, hexane, etc., to produce a resin solution or emulsion. If a relatively low specific volume resistance is desired, an electrically conductive particle is further added to the resin solution or emulsion. The resin solution or emulsion thus prepared is sprayed onto the surface of the carrier to form uniform resin layer thereon. To obtain uniform resin layer, the carrier is preferably maintained in a fluidized state desirably by employing a spray dryer or a fluidized bed. In the case of the resin solution, the solution is sprayed at about 200° C. or lower, preferably at about 100°–150° C., to rapidly remove a solvent from the resultant resin layer. On the other hand, in the case of the resin emulsion, the emulsion is sprayed at a temperature from room temperature to 100° C. to adhere the fused resin to the surface of the carrier. The carrier is coated with the resin in an amount of 0.2–10 weight parts, preferably 1–5 weight parts based on 100 weight parts of the carrier.

The carrier may be a mixture of two or more of the above magnetic particles. For example, a large-sized magnetic particle having an average particle size of 60–120 μm may be mixed with a small-sized magnetic particle having an average particle size of 10–50 μm or a small-sized bonded magnetic particle having an average particle size of 10–50 μm. The mixing ratio may be determined depending upon the particle size, magnetic properties, etc., in particular determined so that the average particle size of mixed carrier falls within the above range of 10–150 μm.

The toner may be either magnetic or non-magnetic. In view of high transferring efficiency, the toner is preferred to be electrically insulating, i.e., have a specific volume resistance of $10^{14}$ Ω·cm or more. Also, a toner which can be easily triboelectrically charged (easily reaches a triboelectric charge of 10 μC/g or more (absolute value)) by the friction with the carrier and/or the doctor blade, etc. is preferable. The volume average particle size of the toner may be 5–10 μm, preferably 5–8 μm.

The toner composition may be the same as those known in the art. Generally, the toner comprises a binder resin (styrene-acrylic copolymer, polyester resin, etc.) and a colorant (carbon black, etc., however not needed to be used when magnetite is used for a magnetic powder component) as the essential component, and a magnetic powder (magnetite, soft ferrite, etc.), a charge-controlling agent (nigrosine, metal-containing azo dye, etc.), a lubricant (polyolefin, etc.) and a mobility improver (hydrophobic silica) as the optional component. When the magnetic powder is used, the content thereof in the toner is preferably 70 weight % or less because a content higher than 70 weight % results in defective fixing. The content of the magnetic powder is preferably 10–60 weight %, more preferably 20–50 weight %. A color toner may be also produced by suitably selecting the colorant.

In the present invention, the magnetization and the volume-average particle size of the toner were measured by a vibrating magnetometer (VSM-3 manufactured by Toei Kogyo K.K.) and a particle size analyzer (Coulter Counter Model TA-II manufactured by Coulter Electronics Co.), respectively. The weight-average particle size of the carrier was calculated from a particle size distribution obtained by a multi-sieve shaking machine.

The specific volume resistance was determined as follows. An appropriate amount (about 10 mg) of the toner or carrier was charged into a dial-gauge type cylinder made of Teflon (trade name) and having an inner diameter of 3.05 mm. The sample was exposed to an electric field of D.C. 100 V/cm (magnetic carrier) or D.C. 4000 V/cm (toner) under a load of 0.1 kgf to measure an electric resistance using an insulation-resistance tester (4329 manufactured by Yokogawa-Hewlett-Packard, Ltd.). The triboelectric charge of the toner was determined as follows. A magnetic developer having a toner content of 5 weight % was mixed well, and blown at a blowing pressure of 1.0 kgf/cm$^2$. The triboelectric charge of the toner thus treated was measured by using a blow-off powder electric charge measuring apparatus (TB-200 manufactured by Toshiba Chemical Co. Ltd.).

The present invention will be further described while referring to the following Examples which should be considered to illustrate various preferred embodiments of the present invention.

EXAMPLE 1

A magnetic toner having an average particle size of 10 μm and a particle size distribution of 4 to 16 μm was prepared as follows. A starting mixture consisting, by weight part, of:

- 45 parts of styrene/n-butyl methacrylate copolymer (weight-average molecular weight (Mw)=$21\times10^4$, number-average molecular weight (Mn)=$1.6\times10^4$),
- 50 parts of magnetite (EPT500 manufactured by Toda kogyo K.K.),
- 3 parts of polypropylene (TP32 manufactured by Sanyo Chemical Industries, Ltd.), and
- 2 part of a negatively chargeable charge-controlling agent (Bontron E-81 manufactured by Orient Chemical Industries)

was kneaded under heating, solidified by cooling, pulverized and classified to obtain a particle having an average particle size of 9 μm. The particle thus obtained was mixed with 0.5 parts by weight of hydrophobic silica (Aerosil R972 manufactured by Nippon Aerosil K.K.), thereby producing a negatively chargeable magnetic toner. The magnetic toner had a specific volume resistance of $10^{15}$ Ω·cm and a triboelectric charge of −23 μC/g.

As the carrier core, flat iron powder having an average particles size of 30 μm, a particle size distribution of 10–50 μm, and a magnetization ($\sigma_{1000}$) of 120 emu/g was used. The carrier was coated with a silicone resin to prepare each resin-coated carrier. A resin-coated carrier of relatively high specific volume resistance was prepared by changing the coating amount of silicone resin, while by changing the addition amount (internal addition and external addition) of carbon black (#600 manufactured by Mitsubishi Chemical Industries) as the electrically conductive particle to attain a relatively low specific volume resistance.

The magnetic toner and the resin-coated magnetic carrier thus produce was mixed in a predetermined ratio to prepare magnetic developers of different toner concentrations.

The developing properties of each of the magnetic developers were tested by continuous development of 1000 sheets of A4 size papers. The operating conditions employed were as follows. Initially, the OPC surface of the photoconductive drum 3 rotating clockwise at a peripheral speed of 30 mm/sec was uniformly charged to −700 V. The permanent magnet member 4, which was formed from a 16-pole ferrite magnet (YBM-3 manufactured by Hitachi Metals, Ltd.) having 20 mm outer diameter and 500 G of surface magnetic flux density, was rotated counterclockwise at a peripheral speed of 147 mm/sec. The developing gap (g) and the doctor gap (t) were 0.4 mm and 0.3 mm respectively. The magnetic developer on the permanent magnet member 4 was biased to −550 V with direct current through the doctor blade 5.

The charging brush 6 was formed by setting a plurality of carbon fiber bristles having a specific volume resistance of $10^5$ Ω·cm into a substrate of SUS304. The length of bristles was 10 min. The transfer roll 7 having an outer diameter of 20 mm was produced by coating around a shaft made Of SUS304 with an ethylene-propylene rubber layer having a hardness (Hs) of 80° and a thickness of 2 mm and pressed against the photoconductive drum 3.

The results of the test are shown in Table 1.

TABLE 1

| Test No. | Specific Volume Resistance (Ω · cm) | Amount of Resin (wt parts)*1 | Amount of Carbon Black internally (wt %)*2 | Amount of Carbon Black externally (wt parts)*3 | Toner Concentration (wt %) | Image Density | Background Fogging | Carrier Adhesion |
|---|---|---|---|---|---|---|---|---|
| 1*4 | $3 \times 10^3$ | 3 | 20 | 2 | 20 | 1.42 | 0.35 | occurred |
| 2 | $4 \times 10^5$ | 3 | 10 | 2 | 20 | 1.40 | 0.08 | none |
| 3 | $6 \times 10^7$ | 0.5 | 0 | 0 | 20 | 1.39 | 0.08 | none |
| 4 | $4 \times 10^{10}$ | 1.5 | 0 | 0 | 20 | 1.37 | 0.10 | none |
| 5*4 | $3 \times 10^{11}$ | 2.0 | 0 | 0 | 20 | 1.01 | 0.08 | none |
| 6 | $6 \times 10^7$ | 0.5 | 0 | 0 | 10 | 1.29 | 0.07 | none |
| 7 | $6 \times 10^7$ | 0.5 | 0 | 0 | 40 | 1.38 | 0.08 | none |
| 8 | $6 \times 10^7$ | 0.5 | 0 | 0 | 60 | 1.39 | 0.08 | none |
| 9 | $6 \times 10^7$ | 0.5 | 0 | 0 | 80 | 1.42 | 0.10 | none |

Note:
*1Weight parts of the resin base on 100 weight parts of the carrier core.
*2Weight percent of carbon black based on the resin layer.
*3Weight parts of carbon black based on 100 weight parts of the carrier.
*4Comparative Example.

As seen from Table 1, in Test No. 1, the carrier adhered to the photoconductive drum due to a low specific volume resistance, while the image density was low in Test No. 5 due to a high specific volume resistance. In the inventive examples (Test Nos. 2–4 and 6–9), images of high quality were obtained without any defects occurred in Test Nos. 1 and 5. Further, as seen from Test Nos. 6–9, the method of the present invention provided high-quality images over a wide toner concentration range from 10 to 80 weight %.

EXAMPLE 2

A non-magnetic toner having an average particle size of 8.5 μm and a particle size distribution of 3–15 μm was prepared in the same manner as in Example 1 except for using the following starting mixture.

87 weight parts of polyester resin (KTR2150 manufactured by Kao Corporation), 10 weight parts of carbon black (#44 manufactured by Mitsubishi Chemical Corporation), 2 weight parts of polypropylene (TP32 manufactured by Sanyo Chemical Industries, Ltd.), and 1 weight part of a charge-controlling agent (Kaya Charge T2N manufactured by Nippon Kayaku Co., Ltd.).

The non-magnetic toner thus prepared had a volume specific resistance of $5\times10^{14}$ Ω·cm and a triboelectric charge of −29 μC/g.

As the carrier, flat iron powder having an average particles size of 50 μm, a particle size distribution of 10–70 μm, and a magnetization ($\rho_{1000}$) of 120 emu/g was used. The carrier was coated with a silicone resin to prepare each resin-coated carrier having a desired specific volume resistance in the same manner as in Example 1.

The image forming tests (continuous development of 1000 sheets of A4 size papers) were carried out under the following operating conditions. Initially, the OPC surface of the photoconductive drum 3 rotating clockwise at a peripheral speed of 30 mm/sec was uniformly charged to −650 V. The permanent magnet member 4, which was formed from a 32-pole ferrite magnet (YBM-3 manufactured by Hitachi Metals, Ltd.) having 20 mm outer diameter and 350 G of surface magnetic flux density, was rotated counterclockwise at a peripheral speed of 74 mm/sec. The developing gap (g) and the doctor gap (t) were 0.4 mm and 0.25 mm, respectively. The magnetic developer on the permanent magnet member 4 was biased to −500 V with direct current through the doctor blade 5. The same charging brush and the transfer roll as employed in Example 1 were used.

The results are shown in Table 2.

TABLE 2

| Test No. | Specific Volume Resistance (Ω · cm) | Amount of Resin (wt parts)*1 | Amount of Carbon Black internally (wt %)*2 | Amount of Carbon Black externally (wt parts)*3 | Toner Concentration (wt %) | Image Density | Background Fogging | Carrier Adhesion |
|---|---|---|---|---|---|---|---|---|
| 10*4 | $1 \times 10^3$ | 3 | 20 | 2 | 30 | 1.41 | 0.35 | occurred |
| 11 | $3 \times 10^5$ | 3 | 10 | 2 | 30 | 1.41 | 0.11 | none |
| 12 | $7 \times 10^8$ | 1.0 | 0 | 0 | 30 | 1.40 | 0.10 | none |
| 13 | $5 \times 10^{10}$ | 1.5 | 0 | 0 | 30 | 1.37 | 0.08 | none |
| 14*4 | $8 \times 10^{12}$ | 2.5 | 0 | 0 | 30 | 1.13 | 0.15 | none |
| 15 | $7 \times 10^8$ | 1.0 | 0 | 0 | 10 | 1.30 | 0.08 | none |
| 16 | $7 \times 10^8$ | 1.0 | 0 | 0 | 40 | 1.40 | 0.09 | none |
| 17 | $7 \times 10^8$ | 1.0 | 0 | 0 | 60 | 1.42 | 0.10 | none |

Note:
*1Weight parts of the resin base on 100 weight parts of the carrier core.
*2Weight percent of carbon black based on the resin layer.
*3Weight parts of carbon black based on 100 weight parts of the carrier.
*4Comparative Example.

As seen from Table 2, in Test No. 10, the carrier adhered to the photoconductive drum due to a low specific volume resistance to produce image of poor quality, while the image density was low in Test No. 14 due to a high specific volume resistance. In the inventive examples (Test Nos. 11–13 and 15–17), images of high quality were obtained without any defects occurred in Test Nos. 11 and 14. Further, as seen from Test Nos. 15–17, the method of the present invention provided high-quality images over a wide toner concentration range from 10 to 60 weight %.

The effects achieved by the construction and function described above will be summarized below.

(1) Since the specific volume resistance of the magnetic carrier is restricted to a particular range to prevent the carrier from adhering to the photoconductive drum, the leak at the charging brush can be effectively avoided, this resulting in reproduction of high-quality images without causing developing defects.

(2) Since a sleeve-less developing roll consisting of only the permanent magnet member is used, the developing unit and the electrophotographic recording apparatus can be miniaturized.

(3) Since directly attracted on the permanent magnet member, the magnetic developer is constantly transported to the developing zone and the shape of magnetic brush on the permanent magnet member is stabilized to improve the developability.

(4) Since a two-component magnetic developer having a wide toner concentration range can be used, a means for regulating the toner concentration is not required, this being advantageous for reducing the size of an image forming apparatus.

What is claimed is:

1. A method of electrostatically forming a visual image, comprising the steps of:

charging the surface of a rotating photoconductive drum to a uniform potential by a charging brush;

exposing the charged surface of said photoconductive drum to a light image to form an electrostatic latent image;

forming a visual toner image on said photoconductive drum by developing said electrostatic latent image in a developing zone with a two-component magnetic developer which is transported to said developing zone by a rotating cylindrical permanent magnet member having on the circumferential surface thereof a plurality of magnetic poles extending along the axial direction, said magnetic developer comprising a magnetic carrier having a specific volume resistance of $10^5$–$10^{10}$ Ω·cm and a magnetic or non-magnetic toner;

transferring said toner image to a recording sheet by means of a transfer roll having an elastic surface; and fixing the transferred toner image to said recording sheet, wherein an outer diameter (D) of said permanent magnet, a peripheral speed (Vm) of said permanent magnet member, a number, (M) of magnetic poles on a circumferential surface of said permanent magnet member, and a peripheral speed (Vp) of said photoconductive drum are selected such that $(\pi D \cdot Vp)/(M \cdot Vm)$ is less than 2 mm.

2. The method according to claim 1, wherein the ratio of the peripheral speed of said permanent magnet member to the peripheral speed of said photoconductive drum is 1–10.

3. The method according to claim 1, wherein said magnetic carrier is coated with a resin layer.

4. The method according to claim 3, wherein said resin layer contains an electrically conductive particle internally added thereto, an electrically conductive particle externally added thereto, or the both.

5. The method according to claim 4, wherein said internally added particle is contained in an amount of 5–15 weight % based on the total amount of said resin layer.

6. The method according to claim 4, wherein said externally added particle is contained in an amount of 0.5–5 weight parts based on 100 weight parts of carrier core.

7. The method according to claim 1, wherein the toner concentration in said magnetic developer containing said magnetic toner is 10–90 weight %.

8. The method according to claim 1, wherein the toner concentration in said magnetic developer containing said non-magnetic toner is 5–60 weight %.

* * * * *